United States Patent [19]

Trammell, Sr.

[11] 4,306,666

[45] Dec. 22, 1981

[54] DISPENSER FOR DATED PRODUCTS

[76] Inventor: J. A. Trammell, Sr., Box 1067, Conway, Ark. 72032

[21] Appl. No.: 138,253

[22] Filed: Apr. 7, 1980

[51] Int. Cl.[3] ..... B65G 65/06

[52] U.S. Cl. ..... 221/289; 211/49 D

[58] Field of Search ..... 312/42, 45, 71, 72; 211/49 D, 49 S, 49 R, 84, 103, 104; 221/108, 111, 268, 289, 295, 107; 242/55.3, 55.53

[56] References Cited

U.S. PATENT DOCUMENTS

| | | |
|---|---|---|
| 1,382,092 | 6/1921 | Kilmer . |
| 1,714,469 | 5/1929 | Hoffman . |
| 2,336,382 | 12/1943 | Albrecht . |
| 3,002,651 | 10/1961 | Gauld . |
| 3,194,431 | 7/1965 | Garvin . |
| 3,318,455 | 5/1967 | Takahashi . |

FOREIGN PATENT DOCUMENTS

| | | | |
|---|---|---|---|
| 647589 | 7/1937 | Fed. Rep. of Germany | 221/103 |
| 333997 | 8/1930 | United Kingdom | 221/108 |

*Primary Examiner*—Stanley H. Tollberg
*Attorney, Agent, or Firm*—Robert R. Keegan

[57] ABSTRACT

There is shown a dispenser for dated products including an elongated magazine with an access opening at the bottom and two compartments for holding containers so they will be one-by-one fed by gravity to the access opening. A gate in the form of a block or the like blocks one or the other of the compartments from the access opening and the gate is blocked from moving from one position to the other by the presence of containers in one side of the access opening. When the compartment on one side is empty the gate is movable to access to the other compartment. The containers are a snug fit in the magazine compartments so they are not readily removed from the top of the dispenser; in addition the dispenser may be provided with a top cover to discourage access from the top of the dispenser. The dispenser may be arranged in a vertical position or, in another embodiment, generally horizontal with a slight slope so that round containers will feed by gravity to the access opening.

11 Claims, 2 Drawing Figures

DISPENSER FOR DATED PRODUCTS

This invention relates to dispensers for dated products, for example smokeless tobacco, and particularly for dispensing such products to the customer in a self-serve type of retail operation. Self-serve dispensers for retail operations are, of course, well-known and may typically employ a cylindrical upright tube with an access opening at the bottom for withdrawing products one at a time so that the remaining products will drop by gravity and place the next product container at the access opening.

The problem encountered with many such dispensers is that customers, in the case of dated products, are likely to sort through the containers to find the latest date and replace the unselected containers by dropping them in the top of the dispenser. This results in the containers being rearranged so that if they were ordinarily arranged to feed in a first-in-first-out order they may no longer be in that order. If the dispenser does not feed out the containers in first-in-first-out order, then some of them may be passed over until the date on the product is so old that the product will be unsalable. The waste which this situation creates is an economic loss which generally increases the cost of the product.

In known dispensers that normally dispense products on a first-in-first-out basis there is generally a lack of features which would deter the customer from sorting through the product containers and defeating the first-in-first-out procedure. In the apparatus according to the invention several features act as a deterrent to sorting through the product; the product is nevertheless attractively displayed and readily accessible to the customer. The product containers are preferably placed on edge so that a longer one of their dimensions is vertical. This means that when a container is removed the remaining containers drop by a substantial distance and this tends to discourage the customers from trying to feed the containers back into the dispenser from the bottom. Since there are a lesser number of containers in a stack which is arranged in such an edge-wise manner, this is compensated for by including two stacks in the container with a gate at the bottom which can be moved over to access the compartment for the second stack after the first compartment is empty. Preferably the dispenser is provided with a cover on top to discourage replacing containers into the top of the dispenser. The cover may or may not be provided with a simple lock so that it can only readily be opened by a key in possession of the route salesman. The cover may be sloped so that containers may not conveniently be rejected and stacked on top of the dispenser.

It is, of course, known to dispense products from an apparatus having multiple stacks wherein the sequence for the delivery of the products is predetermined by the apparatus. For example, U.S. Pat. No. 1,382,092 to Kilmer and U.S. Pat. No. 3,318,455 to Takahashi show apparatus of this nature. Other somewhat similar apparatus is shown by U.S. Pat. No. 1,714,469 to Hoffman, U.S. Pat. No. 2,336,382 to Albrecht, U.S. Pat. No. 3,002,651 to Gauld, and U.S. Pat. No. 3,194,431 to Garvin. These prior devices, however, do not satisfactorily deal with the problems in a self-serve dispenser of dated products wherein it is desirable to provide features so that the customer will be deterred from defeating the first-in-first-out predetermination of the sequence of delivery for the products.

In addition to providing the features and advantages described above, it is an object of the present invention to provide a dispenser for dated products which provides ready access to only a single one of the products at a time and is structured to make the selection of a different one of the products by the customer quite inconvenient.

It is another object of the present invention to provide a dispenser for dated products for delivery of such products on a first-in-first-out basis wherein the dispenser is arranged to discourage replacement of the products in the dispenser once they have been removed by the customer.

It is another object of the present invention to provide a dispenser for dated products with two stack channels for delivering one product at a time by gravity and a gate which blocks one of the two channels until the other channel is empty.

Other objects and advantages of the invention will be apparent from consideration of the following description in conjunction with the appended drawings in which.

Figure 1:
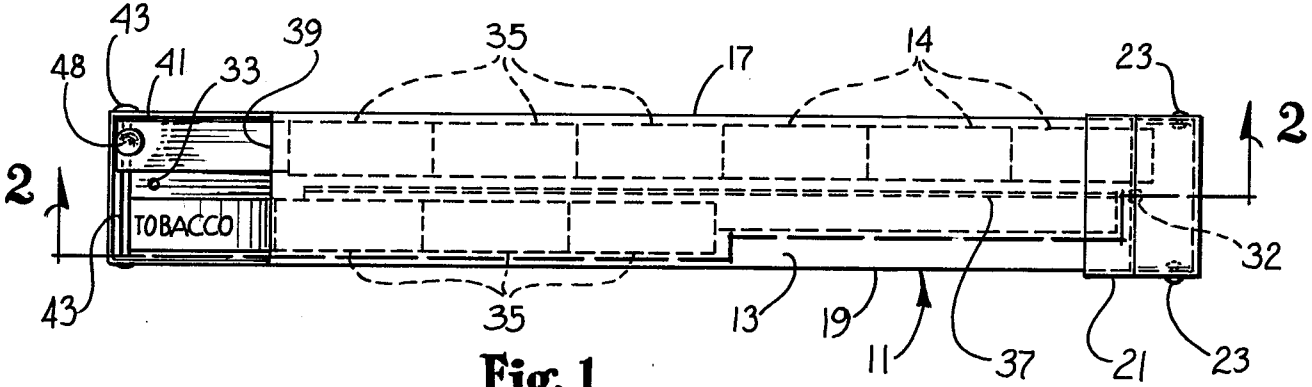
FIG. 1 is a top plan view of a dispenser according to the invention.

Referring to the drawings, a dispenser 11 is shown which is dimensioned and adapted for dispensing smokeless tobacco packages essentially of a round "snuff can" shape. It will be understood that dispensers for other products may be constructed in accordance with the invention including products such as smoking tobacco, photographic film, food products, etc. The purposes and functions of the apparatus of course are directed to dated products which may become unsalable when out-dated. The dispenser 11 is in the form of an elongated rectangular prism having a front 13, a back 15, left side 17, and right side 19.

The dispenser 11 is provided with a cover 21 which may be hingedly attached by rivets 23. Dispenser 11 may be provided with a bottom end 25.

Figure 2:
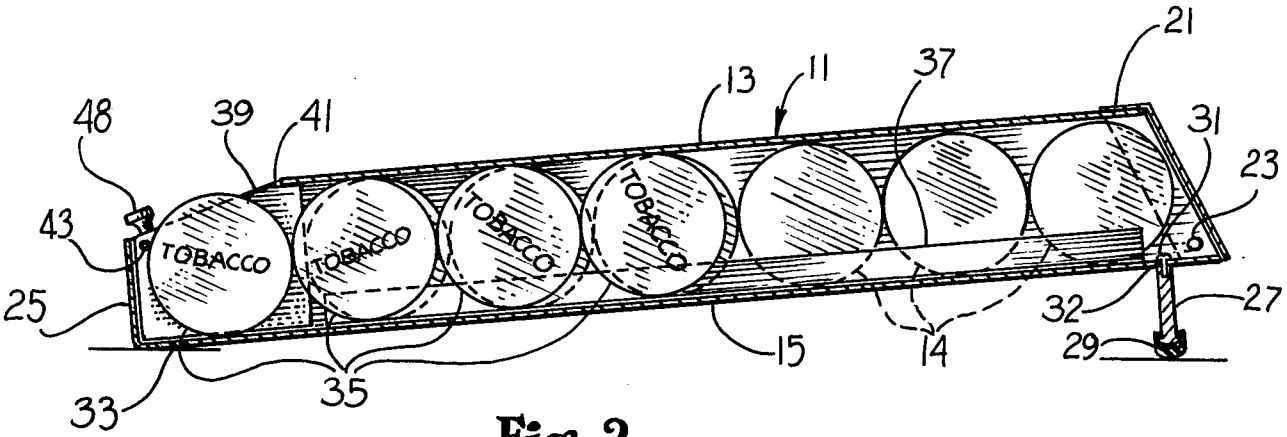
FIG. 2 is a sectional view of the apparatus of FIG. 1 taken along the line 2—2 in FIG. 1.

As previously mentioned, the dispenser may be arranged vertically, or horizontally as illustrated in FIGS. 1 and 2. As seen in FIG. 2 the dispenser, when arranged horizontally, is given a sloping attitude by a short leg 27 having a rubber foot 29. Leg 27 may be a metal or plastic cylinder having a tapped opening at the top to receive a screw 31 which passes through an opening 32 in the back 15 of dispenser 11. Back 15 is also provided with a hole 33 so that leg 27 may be removed and the dispenser 11 may be mounted to a wall or other vertical support by screws or other fasteners extending through holes 32 and 33; the vertical mounting just described will, of course, be the only arrangement suitable for rectangular or other containers not having a circular cross-section. The arrangement of FIGS. 1 and 2 is particularly adaptable to dispense containers 35 for smokeless tobacco which are in the form of a cylinder of circular cross-section and thus are caused to roll by gravity as a result of the slope imparted to the dispenser 11 by the leg 27.

The interior of the dispenser 11 is divided into two channels by a divider 37. While the divider 37 might extend for the full depth of the dispenser it is unnecessary for it to extend the full depth and it may be a relatively narrow strip as illustrated in FIGS. 1 and 2. As shown in FIGS. 1 and 2 the dispenser 11 is formed of sheet metal by cutting, bending and welding or otherwise securing the back, front and sides of the dispenser 11. The divider 37 may also be of sheet metal and is secured in place by spot welding or in other suitable fashion. The dispenser 11 may, of course, be formed of other material such as plastic, which may be formed by molding, extrusion or other methods.

At the left or bottom end of the dispenser 11 as shown in FIGS. 1 and 2, a corner of the dispenser is cut out to provide an opening for extraction of the containers 35. The portion of the interior of the dispenser 11 accessible through opening 39 is shown to contain one product container 35 and also a gate block 41. Block 41 is shaped and dimensioned to fill one-half of the access opening and thus prevent the containers 35 in one or the other of the channels formed by divider 37 from dropping into the access opening space.

As seen in FIG. 1 some of the containers 35 (in dashed lines) have been removed from the right half of the dispenser and it will be seen that when all of the containers in this half of the dispenser have been moved it will then be possible to slide gate block 41 to the right after which the containers in the left half of the dispenser will drop down one position and will be accessible through opening 39. Block 41 is held in position by a pin 43 extending through a hole in block 41. Pin 43 also serves as a stop for the containers 35, especially when dispenser 11 is in the vertical position; since containers 35 rest on pin 43 it is possible to dispense with the bottom end 25 of the apparatus if desired. A handle 48 is provided for block 41 to facilitate shifting it to release the second stack of containers 35.

It will be noted that the divider 37 terminates short of the block 41 so that there is no interference therebetween as block 41 is shifted to the right or to the left. Block 41 is shown being approximately the same dimension as the containers 35; block 41 may be of substantially greater height, up to about twice that of the container, if it is desired to further increase the difficulty of shifting the block 41 before one stack of containers has been exhausted. It will also be noted that the sides 17 and 19 of the dispenser 11 are cut away at the access opening 39 to make it convenient to grasp the containers 35. A straight cut as shown in FIGS. 1 and 2 may be used or an arcuate cut to give greater access to the container may be employed. The gate block 41 is preferably shaped to conform to the cutaway of the sides 17 and 19. A window in front 13 may be provided and positioned to show the presence (or absence) of a container just above gate block 41. Any window won't show the date, preferably.

Operation of the apparatus proceeds as follows. The cover 21 is opened to allow the dispenser 11 to be filled with containers 35. Both sides of the dispenser will be filled and one side will be blocked by the gate block 41. When customers have removed all the containers from one side, the gate block 41 will be moved over to allow access to the containers in the other side of the dispenser. When the dispenser is to be refilled the two sides will be refilled from the top as necessary with later dated containers. Any remaining older dated containers will be at the access opening and will be the first to be taken by the customers. After the older dated containers are exhausted the later dated containers will be served to the access opening.

While the apparatus shown with two channels for stacks of containers is generally preferred, three or more channels may be provided in the dispenser. In the case of three channels two gate blocks would be provided so only one channel would be accessible. In other words, the number of gate blocks will in every case be one less than the number of channels.

In addition to the variations and modifications to the apparatus suggested above other modifications and variations will be apparent to those skilled in the art and the scope of the invention is not to be deemed limited to the particular embodiments and modifications shown or suggested but is to be determined by reference to the appended claims.

What is claimed is:

1. A dispenser for uniformly sized product containers comprising, a hollow elongated prismoidal structure dimensioned to retain at least two stacks of said containers, a divider therein creating two channels for gravity feed of said containers, said structure having an access opening dimensioned to give access to only the lowest one of said containers in each of said channels, and a gate member in the form of a block movably retained in one or another of said channels at said access opening and adapted to block one channel to prevent movement of containers therein to an accessible position, said gate being obstructed by presence of a container behind said access opening and hence movable only when the space behind said opening is empty of containers.

2. Apparatus as recited in claim 1 further including means for restraining said gate member to sliding movement between positions at the bottom of one or another of said channels.

3. Apparatus as recited in claim 1 further including a stop member across the bottom of said structure to support said containers while permitting them to be lifted upwardly and forwardly through said access opening.

4. Apparatus as recited in claim 2 wherein said access opening is in part cut away from the sides of said structure at the bottom end thereof.

5. Apparatus as recited in claim 2 further including means to support the end of said structure opposite said access opening at a slightly elevated position whereby round containers will feed by gravity to said opening.

6. A dispenser for uniformly sized product containers comprising, a hollow elongated prismoidal structure dimensioned to retain at least two side-by-side stacks of said containers, a divider therein creating two channels for gravity feed of said containers, each channel having a width less than the maximum dimension of said containers, said structure having an access opening dimensioned to give access to only the lowest one of said containers in each of said channels, and a gate member movably retained at said access opening and adapted to block access to one or another of said channels, said gate member being, a block movably retained for sliding motion and obstructed by presence of a container behind said access opening in an adjacent channel and hence movable only when the space behind said opening is empty of containers, said dispenser including a rod engaging a hole extending from side-to-side through said block.

7. Apparatus as recited in claim 6 wherein said prismoidal structure has a rectangular cross-section.

8. Apparatus as recited in claim 6 wherein said rod forms a stop member across the bottom of said structure to support said containers while permitting them to be lifted upwardly and forwardly through said access opening.

9. Apparatus as recited in claim 6 wherein said access opening is in part cut away from the sides of said structure at the bottom end thereof.

10. Apparatus as recited in claim 6 further including a stop member across the bottom of said structure to support said containers while permitting them to be lifted upwardly and forwardly through said access opening.

11. Apparatus as recited in claim 6 further including means to support the end of said structure opposite said access opening at a slightly elevated position whereby round containers will feed by gravity to said opening.

* * * * *